United States Patent [19]

Berg

[11] Patent Number: 4,881,358

[45] Date of Patent: Nov. 21, 1989

[54] METHOD OF PACKAGING ARTICLES OF A COMPRESSIBLE MATERIAL

[75] Inventor: Anders Berg, Tranas, Sweden

[73] Assignee: Shampoo Sponge International B.V., Berkel en Rodenrijs, Netherlands

[21] Appl. No.: 628,745

[22] Filed: Jul. 9, 1984

[30] Foreign Application Priority Data

Jul. 22, 1983 [SE] Sweden ..... 8304094

[51] Int. Cl.[4] ..... B65B 1/24; B65B 13/20; B65B 63/04

[52] U.S. Cl. ..... 53/399; 53/429; 53/435; 53/439; 53/450

[58] Field of Search ..... 53/116, 117, 429, 435, 53/438, 439, 450, 459, 513, 521, 526, 528, 529, 530, 550, 575, 547, 399; 425/302, 422, 424, 439, 440, 461; 83/236

[56] References Cited

U.S. PATENT DOCUMENTS

| | | | |
|---|---|---|---|
| 1,497,183 | 6/1924 | Mitchell | 53/459 X |
| 2,001,709 | 5/1935 | Davidson | 53/429 X |
| 2,008,473 | 7/1935 | Shephard | 53/526 X |
| 2,053,744 | 9/1936 | Sailer | 53/117 X |
| 3,180,065 | 4/1965 | Churchill | 53/435 X |
| 3,351,339 | 11/1967 | Beard et al. | 493/439 X |
| 3,655,856 | 4/1972 | Spivy | 83/236 X |
| 3,978,703 | 9/1976 | Primich et al. | 83/236 X |
| 4,117,647 | 10/1978 | Rossi | 53/551 X |

FOREIGN PATENT DOCUMENTS

| | | | |
|---|---|---|---|
| 2610776 | 10/1976 | Fed. Rep. of Germany | 53/117 |

*Primary Examiner*—John Sipos
*Assistant Examiner*—Beth Bianca
*Attorney, Agent, or Firm*—Harness, Dickey & Pierce

[57] ABSTRACT

A method of packaging articles of a compressible material, such as cleaning sponges, according to which a blank of arbitrary length is cut such that its thickness corresponds to the thickness of the article and its width corresponds to the longest dimension of the article. The blank is folded lengthwise along its center line once and is then again folded along the center line of the once folded blank a second time. The blank, thus folded twice, is advanced through a piece of piping the outer jacket face of which serves as a shaping template for shaping a web of foil into a tubular cover enclosing the blank and the piece of piping coaxially. The tubular cover is brought along by the advancing twice-folded blank at the discharge end of the piece of the piping and the twice-folded blank is cut while enclosed in the tubular cover, into pieces in such a manner that the length of the blank corresponds to the width of the article.

3 Claims, 1 Drawing Sheet

METHOD OF PACKAGING ARTICLES OF A COMPRESSIBLE MATERIAL

BACKGROUND OF THE INVENTION

The subject invention concerns a method of packaging articles of a compressible material.

As one example of articles of this type may be mentioned cleaning sponges which are on sale for instance in petrol stations and in shops specializing in car accessories. Cleaning sponges of this kind are generally made from cellular plastics into which schampoo and wax are injected to be used for car washing. Sponges of this kind may have length, width and thickness dimensions of $18 \times 10 \times 3{,}5$ cm. Consequently, the total volume of this sponge is 630 $cm^3$. The sponge is usually enclosed in a cover of plastic film, which serves to prevent the sponge from absorbing moisture and dirt from the time of its manufacture until it reaches the place of sale. The sales price of sponges of this kind is low, depending on the low production costs. However, owing to the large space required by each individual sponge in transport, storage and display, the handling cost per unit is comparatively high. Thus, there is a need for reducing the space required by the individual sponges. This may be effected by packaging the sponges in a partly compressed state in a box at the factory. However, as soon as such partly-compressed sponges are unpacked from their box at the place of sale they will immediately resume their original bulky shape and will still require considerable space in display stands or on shelves.

The purpose of the subject invention is to provide a method of packaging articles of the kind referred to so as to render these articles less bulky and easier to handle and thus reduce their need for space in handling, storage and marketing in shops and the like.

SUMMARY OF THE INVENTION

The method in accordance with the invention is characterized by the steps of folding the blank lengthwise along its centre line a first time, folding the blank lengthwise along the centre line of the folded blank a second time, advancing the blank thus folded twice lengthwise through a piece of pipe, the outer jacket face of said pipe serving as a shaping template to form and weld a web of foil into a tubular cover enclosing coaxially the discharge end of said pipe and said twice-folded blank, said twice-folded blank advancing said tubular cover at the discharge end of said piece of pipe, and cutting said blank with said tubular cover thereon into pieces of a predetermined length, said cut-off pieces thus forming an article packaged in said tubular cover, the surface of said article exposed at the two ends of said tubular cover corresponding to the lengthwise marginal edges of the finished article in its non-folded condition.

BRIEF DESCRIPTION OF THE DRAWINGS

The invention will be explained in closer detail in the following with reference to the accompanying drawings, wherein.

DETAILED DESCRIPTION OF PREFERRED EMBODIMENTS

Figure 1:
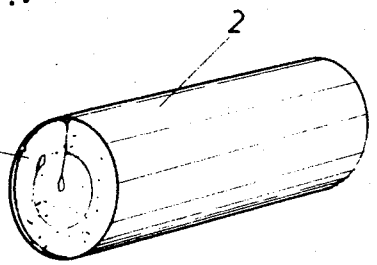
FIG. 1 is a perspective view illustrating a cleaning sponge packaged in accordance with the teachings of the subject invention.

The cleaning sponge 1 illustrated in FIG. 1 is doubled upon itself twice and enclosed in a sleeve of plastic film. The length of the sleeve corresponds to the width of the finished sponge 1.

Figure 2:
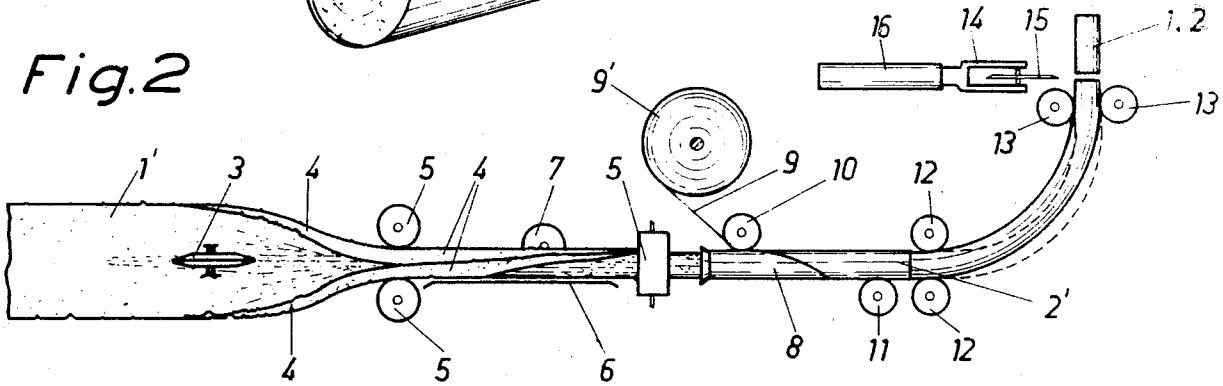
FIG. 2 is a schematic view from above of a machine designed to manufacture and package cleaning sponges in accordance with the subject invention.

In the machine illustrated in FIG. 2 for the manufacture of packaged cleaning sponges a continuous web of sponge black 1' is advanced. The sponge blank is already injected with schampoo, wax and other water-soluble additions as desired. The sponge blank 1' is advanced with its centre line in alignment underneath a first rotating folding wheel 3. The face of abutment of said wheel 3 against the sponge blank 1' is comparatively pointed and narrow and the sponge blank 1' is pressed against the supporting face by the wheel 3. During this operation the outer marginal portions 4 of the sponge blank 1' will be folded upwards at an angle of 90°. The folding-over of the marginal portions 4 of the sponge blank 1' is completed to 180° by two vertically mounted guide rollers 5.

The folded blank 1' is advanced further past a vertical abutment face 6 against which a second rotating folding wheel 7 presses against the centre of the folded sponge blank, whereby the outer marginal edges 4 of the sponge blank 1' are bent somewhat at an angle from the abutment face 6. This starts the second folding operation of the sponge blank 1', which operation is completed by an additional two guide rollers 5, the latter, in contrast to the first roller pair 5, being mounted for rotation horizontally.

The sponge blank 1', thus folded twice, is fed into an elongate pipe 8 serving as a folding tool to fold a web of foil 9 which is supplied from one side of the path of advancement of the blank from a vertically mounted material-holding roll 9'. The web of foil 9 extends past a deflecting roll 10 positioned by the pipe 8. Folding members , not shown, shape the web of foil 9 into a tube 2' about the pipe 8 and the tube 2' is welded together by means of a heating roller 11 abutting against the tube on the pipe 8.

At the feed-out end of the pipe 8 the twice folded sponge blank and the tubular cover 2' are advanced together by a first pair of driving rollers 12. The rollers of this roller pair are driven in synchrony with the earlier-described means for the advancement of the sponge blank. Spaced from this first pair of driving roller 12 is a second pair of driving rollers 13, the latter being arranged in such a manner that these latter rollers advance a length of the tube 2' enclosing the sponge blank 1' intermittently at an angle relative to the previous direction of advancement of the sponge blank 1' past a cutting device 14. The latter is in the form of a blade 15 which is supported at the end of a reciprocating piston-and-cylinder unit 16 moving perpendicularly to the tube blank 1', 2'. While the cutting device 14 cuts off a length of the tube blank the latter is retained by the driving roller pair 13 while at the same time the first driving roller pair 12 advances the tube blank continuously. Consequently, the latter will extend in a somewhat wider bend up to the second driving roller pair 13, as indicated in FIG. 2 in dashed lines. When the cutting operation is completed the tube blank 1', 2' is advanced at a high speed by the second driving roller pair 13 to compensate for the blank-retainment time.

The production of packaged cleaning sponges described in the aforegoing may be effected in a fully automated way at a very high speed, thus giving an inexpensive product. In the method in accordance with the invention only a small amount of plastic film is used to form the protective cover around the cleaning sponge and consequently the material savings are considerable compared with prior-art methods according to which the cleaning sponges are enclosed in film in its "released", that is, maximum bulk condition and consequently over its entire surface area. Owing to the packaging method in accordance with the invention the cleaning sponge will occupy only between about a third and a fourth of the space required by a cleaning sponge packaged in the conventional way.

The method in accordance with the invention is not limited to the embodiment described in the aforegoing but a number of modifications are possible within the scope of the appended claims. It should be apparent to the artisan in the field that the method is applicable for packaging other compressible articles than cleaning sponges. The method could likewise be performed with the aid of other means than those used in the illustrated machine.

What I claim is:

1. A method of packaging a compressible blank such as a sponge or the like in a state of compression with a removable foil, comprising folding the blank lengthwise along a transverse centre line a first time, folding the once folded blank lengthwise along a transverse centre line of the folded blank a second time, advancing the blank thus folded twice lengthwise through a piece of pipe, forming and welding a web of foil into a tubular cover around the outer side surface of the pipe to enclose coaxially the discharge end of sid pipe and said twice-folded blank, advancing said twice-folded blank and the encircling tubular cover beyond the discharge end of said piece of pipe, and cutting said blank and the encircling tubular cover into pieces of a predetermined length, said cut-off pieces thus forming an article packaged in said tubular cover, the surface of said article exposed at the two ends of said tubular cover corresponding to the lengthwise marginal edges of the finished article in its non-folded condition, said cover being removable to access said blank for its expansion and use.

2. The method as set forth in claim 1 wherein the advanced twice-folded blank and encircling cover are turned through a substantial angle between a pair of longitudinally spaced guide rollers and the cutting is accomplished adjacent the downstreammost of the rollers.

3. The method as set forth in claim 2 wherein the cutting is accomplished while the downstream roller does not advance the folded blank and encircling tubular cover for changing the angular relationship of the portion of the twice-folded blank and encircling cover between the pair of guide roller during the cutting off operation for accelerating the movement of the twice-folded blank and encircled tubular cover through the downstreammost roller after the cutting operation has been completed.

* * * * *